United States Patent [19]

Lipperts

[11] 4,115,672

[45] Sep. 19, 1978

[54] VACUUM SWITCH AND ELECTRO-MAGNETIC COIL ASSEMBLY THEREFOR

[75] Inventor: Joseph H. F. G. Lipperts, Hengelo, Netherlands

[73] Assignee: Hazemeijer B. V., Hengelo, Netherlands

[21] Appl. No.: 770,276

[22] Filed: Feb. 18, 1977

[30] Foreign Application Priority Data

Feb. 19, 1976 [NL] Netherlands ..... 7601690

[51] Int. Cl.[2] ..... H01H 33/66

[52] U.S. Cl. ..... 200/144 B; 200/147 R

[58] Field of Search ..... 200/144 B, 147 R

[56] References Cited

FOREIGN PATENT DOCUMENTS 1,258,015 12/1971 United Kingdom ..... 200/144 B

*Primary Examiner*—Robert S. Macon

*Attorney, Agent, or Firm*—Watson, Cole, Grindle & Watson

[57] ABSTRACT

A vacuum switch comprises an evacuated electrically conducting cylindrical envelope having two movable contact elements therein making electrical contact with one another in a closed condition of the switch and being separated by an electrical insulating gap in the open condition of the switch. The gap is symmetrically disposed with respect to the contact axis of the cylindrical envelope and an electro-magnetic coil is disposed coaxially around the envelope and connected in series with the two contact elements such that in the closed condition of the switch an axial magnetic field is produced in the region of the current passage between the closed contact elements. The ends of the electro-magnetic coil are connected to respective electrically conducting joining rings, one of which is connected to the cylindrical envelope, and the other of which is connected to an electrically conducting disc having a central bore in which the first central conductor is mounted. One end of the cylindrical envelope extends beyond the last mentioned ring and is connected to a disc-shaped electrically conducting base having a central bore in which a central second conductor is mounted. Insulating material is provided between the electro-magnetic coil, the last mentioned joining ring and the envelope as well as between the electrically conducting disc and the disc-shaped base. One of the contact elements is connected to the first central conductor and the other contact element and the second central conductor connect the circuit to be controlled by the vacuum switch.

4 Claims, 3 Drawing Figures

VACUUM SWITCH AND ELECTRO-MAGNETIC COIL ASSEMBLY THEREFOR

Figure 1:
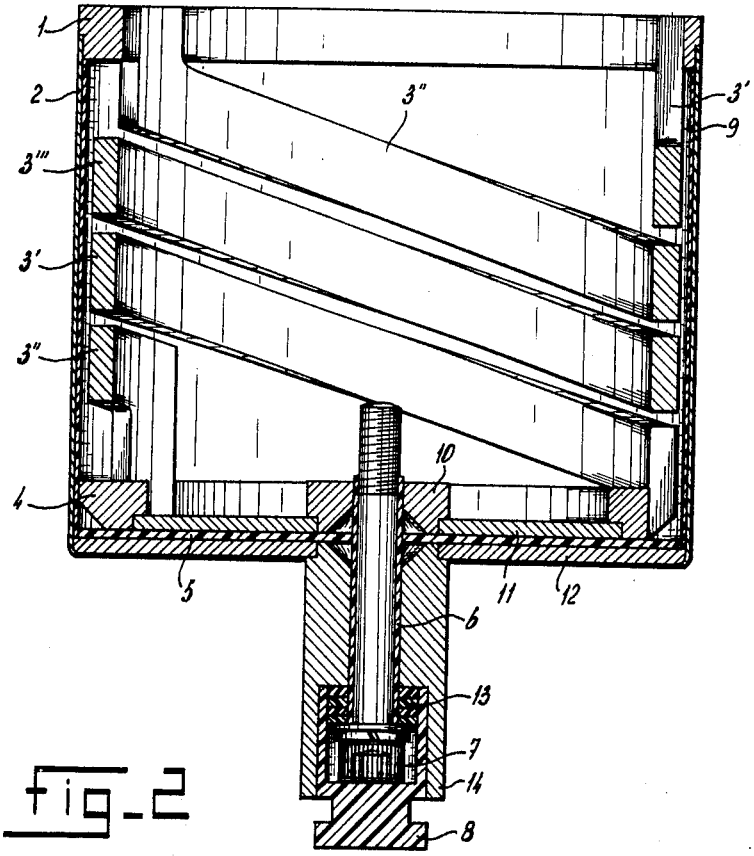

This invention relates to vacuum switches and electromagnetic coil assemblies therefor.

British patent specification No. 1,258,015 discloses a vacuum switch comprising an evacuated cylindrical envelope having therein two relatively movable contact elements which in the open condition of the switch are electrically insulated from one another by an insulating gap symmetrically disposed on the central axis of the cylindrical envelope, an electro-magnetic coil being coaxially disposed around the envelope, and the coil being electrically connected in series with the two contact elements in the closed condition of the switch and producing an axial magnetic field in the region of current passage between the closed contact elements.

In this known switch one end of the coil is intended to be connected to an external circuit and the other end of the coil is connected to one of the contact elements of the vacuum switch, the other contact element of the switch also being used to establish connection with the external circuit. When the vacuum switch is switched off, the movable contact element is moved away from the stationary contact element and due to the fact that the current to be interrupted flows also through the coil, an axial magnetic field is produced in the region of the contact gap, the magnetic field extending substantially parallel to the generated arc across the gap. The axial magnetic field improves the interruption capability of the vacuum switch.

It is very important that the flux lines of the magnetic field in the gap extend in the axial direction parallel to the central axis of the cylindrical envelope, so that the interfering magnetic fields in the gap resulting from electric currents in the coil connections and in other adjacent conductors are kept as small as possible. Such interference of the field results in the arc being unable to use the entire contact surface so that, according to a publication by Mitchell "High Current Vacuum Art", part I, "An Experimental Study", Proceedings IEE, vol. 117, No. 12, Dec. 1970, pages 2315–2326, the interruption capability of the switch deteriorates because the contact area is reduced, whilst the interruption capability varies as an inverse proportional to the contact surface.

It is an object of the present invention to eliminate as much as possible any interfering magnetic fields in the contact gap, i.e. magnetic fields whose flux lines do not extend in the axial direction. To this end it is proposed to establish the electro-magnetic coil connections in a co-axial arrangement with respect to the cylindrical envelope.

According to one aspect of the present invention a vacuum switch comprises an evacuated cylindrical envelope having therein two contact elements which are relatively movable such that the two contact elements make electrical contact in the closed condition of the switch and are separated by an electrically insulating gap in the open condition of the switch, said gap being symmetrically disposed with respect to the contact axis of the cylindrical envelope, an electro-magnetic coil disposed coaxially around the envelope, the electro-magnetic coil being connected in series with the two contact elements when the switch is in the closed condition and producing an axial magnetic field in the region of current passage between the closed contact elements, the ends of the electro-magnetic coil being connected to respective electrically conducting joining rings one of which is connected to the electrically conducting cylindrical envelope coaxially surrounding the electro-magnetic coil and the other of which is connected to an electrically conducting disc in a central bore of which a first central conductor is mounted, one end of the cylindrical envelope extending beyond said other ring and being connected to a disc-shaped electrically conducting base, in a central bore of which a second central conductor is mounted, insulating material being provided between the electro-magnetic coil, said other joining ring and the envelope, as well as between the electrically conducting disc and the disc-shaped base, one of the contact elements being connected to the first central conductor, whereas the other contact element and the second central conductor serve to connect the circuit to be controlled to the vacuum switch.

In the vacuum switch according to the invention all conductors supplying the current to and from the coil are arranged such that the current is distributed uniformly so that its magnetic field at the region of the contact gap can be neglected.

In a preferred embodiment, the two central conductors are provided with a common central bore through which extends a bolt with insulating material between said bore and said bolt, the part of said bolt projecting from the first central conductor being provided with a screw thread cooperating with a threaded hole in said one contact element.

The electro-magnetic coil may comprise three parallel helical conductors the connection points of which to the joining rings are spaced apart by 120° in a symmetrical arrangement. This has the advantage that in comparison with the coil having only one winding with the same section, the total cooling surface is increased so that heat dissipation is improved and the coil may be embodied in a more compact form.

According to another aspect of the invention an electro-magnetic coil assembly for use in the vacuum switch of said one aspect of the invention is such that the structure comprising the joining rings the electro-magnetic coil, the cylindrical envelope, the disc, the first central conductor, the disc-shaped base with the second conductor and the insulating material constitutes a self-supporting structure in the shape of a cup in which a vacuum switch assembly may be mounted with the aid of the bolt.

Figure 2:
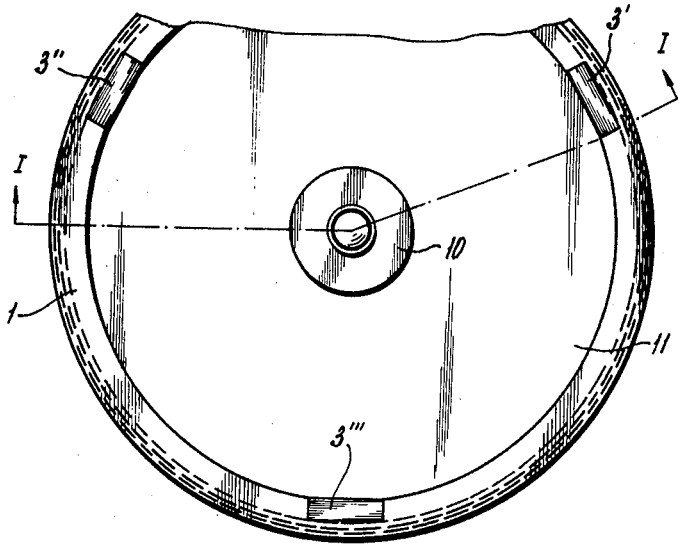
Figure 3:
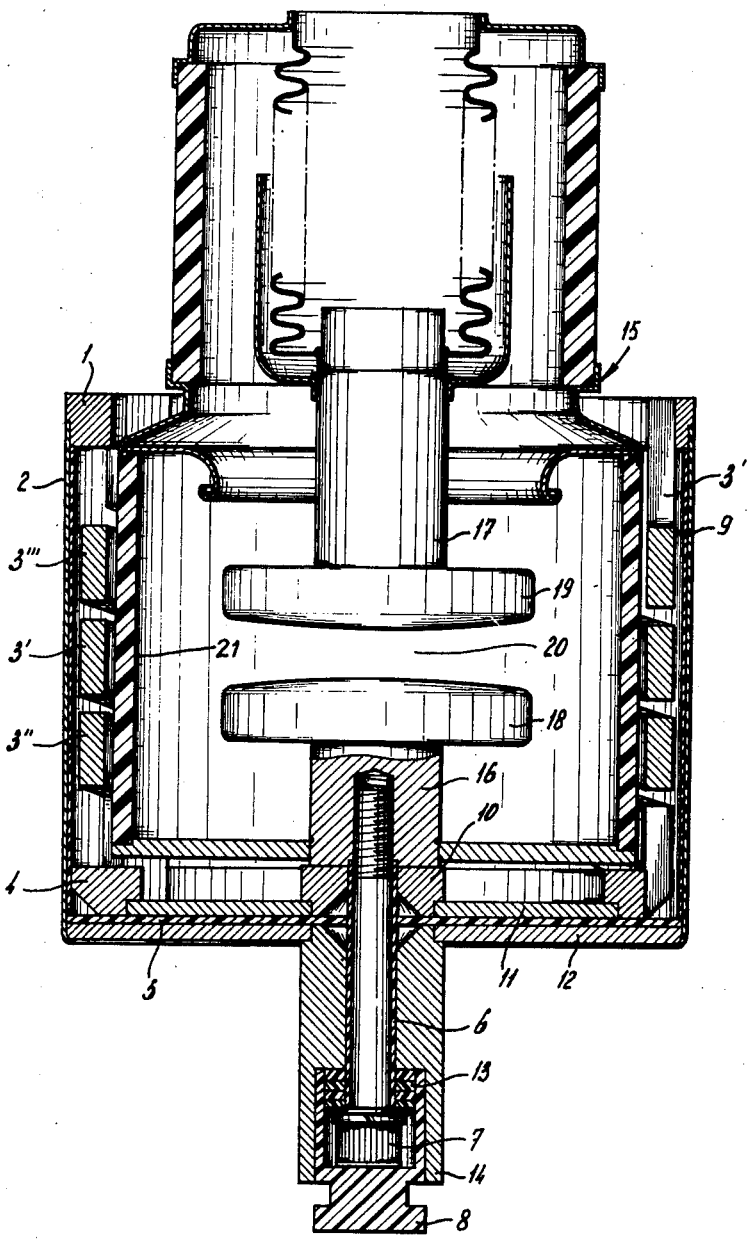

The invention will now be described in more detail and by way of example with reference to the accompanying drawings, wherein:

FIG. 1 is a longitudinal sectional view of an electro-magnetic coil assembly according to the invention taken on the line I—I of FIG. 2, FIG. 2 is a top view of the coil assembly of FIG. 1, and FIG. 3 is a similar sectional view to that of FIG. 1 but showing the complete vacuum switch.

As is apparent from FIGS. 1 and 2, the electro-magnetic coil assembly comprises three parallel helical conductors 3', 3'' and 3''', one end of each being electrically connected to an upper joining ring 1 and the other end of each being electrically connected to a lower joining ring 4. As shown in FIG. 2, the connection points of the three helical conductors 3', 3'' and 3''' to the upper joining ring 1 are spaced apart by 120° in a symmetrical arrangement. Each helical conductor 3', 3'' and 3''' subtends a complete revolution about the central axis of the conductors 3', 3'' and 3'' so that the connection points of the conductors to the lower joining ring 4 are positioned perpendicularly below the connection points to the upper joining ring 1.

The electro-magnetic coil is co-axially surrounded by a cylindrical envelope 2 of conducting material one end of which extends beyond the lower joining ring 4 and is closed by a disc-shaped electrically conducting base 12. At its top, the envelope 2 is electrically connected to the upper joining ring 1. The lower joining ring 4 is electrically connected to a central conductor 10 by means of a disc 11. The conductor 10 is located in a central bore of the disc 11 and the base 12 is provided with a central bore wherein a second central conductor 14 is secured. Insulating material 9 is provided between the coils 3', 3'', 3''' and the envelope 2, and insulating material 5 is also provided between the disc 11 and the base 12. The two conductors 10, 14 have a common central bore accommodating a bolt 7. The bolt 7 is insulated from the two conductors 10, 14 by an insulating sleeve 6, an insulating plug 8 and insulating rings 13.

FIG. 3 illustrates a vacuum switch 15 comprising a vacuum switch assembly fitted into the assembly of FIGS. 1 and 2. A lower conductor 16 of the vacuum switch 15 is secured in the cup-shaped assembly of FIGS. 1 and 2 by means of the bolt 7 such that the conductor 16 is drawn against the central conductor 10.

When the vacuum switch 15 depicted in FIG. 3 is to be connected in a circuit, one side of the circuit is connected to the central conductor 14 and the other side is connected to an upper conductor 17 of the vacuum switch 15. When the vacuum switch 15 is opened, contact elements 18, 19 are drawn from each other by raising the upper movable conductor 17, this movement being accommodated by bellows attached to the conductor 17. An arc will then be generated between the two contact elements 18, 19 and the current to be interrupted flows from the central conductor 14, the base 12, the envelope 2, the upper joining ring 1, the conductors 3', 3'', 3''', the lower joining ring 4, the disc 11 and the other central conductor 10 towards the lower conductor 16 of the vacuum switch 15 and from there via the arc towards the upper contact element 19 of the vacuum switch. An axial magnetic field is produced by the conductors 3', 3'', 3''' in the region of the contact gap 20. The vacuum switch is enclosed by insulated wall 21.

The current is supplied to the conductors 3', 3'', 3''' such that the current does not cause any disturbance in the contact gap 20 of the axial magentic field produced by the conductors 3', 3'', 3'''.

It will be noted that the vacuum switch shown in FIG. 3 has a higher current interruption capacity than the vacuum switch assembly alone, so that the vacuum switch assembly without the electro-magnetic coil assembly can be used as a load switch and together with the coil assembly as a power switch. As a result thereof one switch can be produced in large quantities, which reduces the cost, and in addition several switches can be made suitable for higher capacities in current plants by the provision of a coil assembly in accordance with FIG. 1. This can be realised in a simple manner because the connections and the dimensions of the switch assembly with or without the coil assembly show only slight differences.

What I claim is:

1. A vacuum switch comprising an evacuated electrically conducting cylindrical envelope having therein two contact elements which are relatively movable such that the two contact elements make electrical contact in the closed condition of the switch and are separated by an electrically insulating gap in the open condition of the switch, said gap being symmetrically disposed with respect to the central axis of said cylindrical envelope, an electro-magnetic coil disposed coaxially around said cylindrical envelope, said electro-magnetic coil being connected in series with said two contact elements when the switch is in the closed condition and producing an axial magnetic field in the region of current passage between the closed contact elements, the ends of the electro-magnetic coil being connected to respective electrically conducting joining rings one of which is connected to said electrically conducting cylindrical envelope coaxially surrounding the electro-magnetic coil and the other of which is connected to an electrically conducting disc in a central bore of which a first central conductor is mounted, one end of said cylindrical envelope extending beyond said other ring and being connected to a disc-shaped electrically conducting base, in a central bore of which a second central conductor is mounted, insulating material being provided between the electro-magnetic coil, said other joining ring and the envelope as well as between the electrically conducting disc and the disc-shaped base, one of the contact elements being connected to the first central conductor, whereas the other contact element and the second central conductor serve to connect the circuit to be controlled to the vacuum switch.

2. A vacuum switch according to claim 1, wherein the two central conductors are provided with a common central bore through which extends a bolt with insulating material between said bore and said bolt, the part of said bolt projecting from the first central conductor being provided with a screw thread cooperating with a threaded hole in said one contact element.

3. A vacuum switch according to claim 1, wherein the electro-magnetic coil consists of three parallel helical conductors the connection points of which to the joining rings are spaced apart by 120° in a symmetrical arrangement.

4. An electro-magnetic coil assembly for use in a vacuum switch according to claim 1, wherein the structure comprising the joining rings, the electro-magnetic coil, said cylindrical envelope, the disc, the first central conductor, the disc-shaped base with the second conductor and the insulating material constitutes a self-supporting structure in the shape of a cup in which a vacuum switch assembly may be mounted with the aid of the bolt.

* * * * *